US009295138B2

(12) United States Patent
Kumada

(10) Patent No.: US 9,295,138 B2
(45) Date of Patent: Mar. 22, 2016

(54) LIGHTING DEVICE AND LUMINAIRE USING THE SAME

(71) Applicant: Panasonic Intellectual Property Management Co., Ltd., Osaka (JP)

(72) Inventor: Kazuhiro Kumada, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/546,772

(22) Filed: Nov. 18, 2014

(65) Prior Publication Data

US 2015/0173152 A1 Jun. 18, 2015

(30) Foreign Application Priority Data

Dec. 16, 2013 (JP) ..... 2013-259393

(51) Int. Cl.
*H05B 37/02* (2006.01)
*H05B 33/08* (2006.01)

(52) U.S. Cl.
CPC ..... *H05B 37/02* (2013.01); *H05B 33/0818* (2013.01); *H05B 33/0851* (2013.01)

(58) Field of Classification Search
CPC ..... H05B 33/0815; H05B 33/0818; H05B 37/029; H05B 37/02; H05B 41/3925; H05B 41/391; H05B 41/2828; H05B 33/0803
USPC ..... 315/307, 294, 224, 209 R
See application file for complete search history.

(56) References Cited

U.S. PATENT DOCUMENTS

2011/0062870 A1* 3/2011 Kanbara ..... H05B 33/0815 315/77
2011/0193495 A1* 8/2011 Mishima ..... H02M 3/1588 315/307
2011/0316494 A1* 12/2011 Kitamura ..... H02M 1/088 323/229
2012/0007512 A1* 1/2012 Kim ..... H05B 33/0821 315/152
2012/0187863 A1 7/2012 Nonaka et al.
2013/0141003 A1 6/2013 Esaki et al.

FOREIGN PATENT DOCUMENTS

JP 58-144864 9/1983
JP 2012-155861 A 8/2012
JP 2013-084380 A 5/2013
JP 2013-089286 A 5/2013
JP 2013-118133 A 6/2013

* cited by examiner

*Primary Examiner* — Douglas W Owens
*Assistant Examiner* — Syed M Kaiser
(74) *Attorney, Agent, or Firm* — Renner, Otto, Boisselle & Sklar, LLP

(57) ABSTRACT

A lighting device includes a step-down chopper circuit and a controller configured to control the step-down chopper circuit. The controller is configured to turn on and off a low-side switching device in the step-down chopper circuit at a fixed frequency. The controller includes an operation unit configured to determine a reference voltage value, an output unit configured to output, as a difference signal, a difference between the reference voltage value determined by the operation unit and an average value of a voltage proportional to a current flowing through the switching device, and a control circuit configured to determine an on-time period of the switching device. The control circuit includes an oscillator configured to generate a voltage signal shaped like teeth of a saw. The control circuit is configured to determine the on-time period of the switching device based on the voltage signal and the difference signal.

9 Claims, 17 Drawing Sheets

LIGHTING DEVICE AND LUMINAIRE USING THE SAME

CROSS-REFERENCE TO RELATED APPLICATIONS

The application is based upon and claims the benefit of priority of Japanese Patent Application No. 2013-259393, filed on Dec. 16, 2013, the entire contents of which are incorporated herein by reference.

TECHNICAL FIELD

The present disclosure relates generally to lighting devices and luminaires using the same, and more particularly, to a lighting device configured to control light output (to adjust light intensity) of a light source that includes a solid-state light emitting device(s) and a luminaire using the same.

BACKGROUND ART

In recent years, there has been proposed lighting devices configured to control light output of semiconductor light emitting devices (i.e., adjust optical intensity of the semiconductor light emitting devices) and luminaires including the lighting devices (for example, see JP 2013-118133A, hereinafter referred to as "Document 1").

As shown in FIG. 17, a lighting device 81 described in Document 1 includes a DC power supply circuit 82, a step-down chopper circuit 83, and a control circuit 84.

The step-down chopper circuit 83 includes a diode 85 and a switching device 86 connected in series between output ports of the DC power supply circuit 82, and an inductor 88 to be connected in series with a light source load 87 between two terminals (between an anode and a cathode) of the diode 85.

A resistor 89 for detecting a current (a chopper current) flowing through the switching device 86 is interposed between a source terminal of the switching device 86 and a negative electrode of the DC power supply circuit 82.

The control circuit 84 is formed of a control integrated circuit 90 and its peripheral components. A fourth pin P4 of the integrated circuit 90 is a terminal for detecting the above-described chopper current, and is electrically connected with a noise filter (not shown) that is formed of a resistor and a capacitor and is provided in the integrated circuit 90.

The control circuit 84 is configured to turn on the switching device 86 when the chopper current detected through the fourth pin P4 of the integrated circuit 90 becomes zero. The control circuit 84 is also configured to turn off the switching device 86 when the chopper current detected through the fourth pin P4 of the integrated circuit 90 reaches a first predetermined value.

In the lighting device 81, the control circuit 84 turns off the switching device 86 when the chopper current detected through the fourth pin P4 of the integrated circuit 90 reaches the first predetermined value. Accordingly, in the lighting device 81, an on-time period of the switching device 86 can be changed by changing the first predetermined value. The lighting device 81 can thereby control light output of the light source load 87.

However, in the lighting device 81, the fourth pin P4 of the integrated circuit 90 is electrically connected to the noise filter (an RC circuit) which is formed of the resistor and the capacitor provided in the integrated circuit 90. Accordingly, in the lighting device 81, a delay will possibly occur in turning off the switching device 86. That is, in the lighting device 81, the noise filter (the RC circuit) deforms a wave-shape of the chopper current (i.e., a delay time is added to the chopper current when the chopper current passes through the noise filter), and accordingly a delay will occur in turning off the switching device 86. In the lighting device 81, it is therefore difficult to precisely change the on-time period of the switching device 86. In addition, in the lighting device 81, it is difficult to shorten the on-time period of the switching device 86 to be smaller than the delay time of the noise filter (the RC circuit).

SUMMARY

The present invention has been made in view of the above-described problems, and an object thereof is to provide a lighting device in which an on-time period of a switching device can be changed precisely, and a luminaire using the lighting device.

A lighting device according to one aspect of the present invention is a lighting device configured to control light output of a light source that includes a solid-state light emitting device(s). The lighting device includes: a step-down chopper circuit configured to step down an input DC voltage to a DC voltage to be supplied to the light source; and a controller configured to control the step-down chopper circuit. The controller is configured to turn on and off a low-side switching device in the step-down chopper circuit at a fixed frequency. The controller includes: an operation unit configured to determine a reference voltage value based on a light output level designated by a light output control signal that instructs a light output of the light source, and a forward voltage of the light source; an output unit configured to output, as a difference signal, a difference between the reference voltage value determined by the operation unit and an average value of a voltage that is proportional to a current flowing through the switching device; and a control circuit configured to determine an on-time period of the switching device. The control circuit includes an oscillator configured to generate a voltage signal shaped like teeth of a saw. The control circuit is configured to determine the on-time period of the switching device based on a level of the voltage signal generated by the oscillator and a level of the difference signal supplied from the output unit.

A luminaire according to one aspect of the present invention includes: the light source; and the lighting device configured to light the light source.

In the lighting device and the luminaire according to one aspect of the present invention, the on-time period of the switching device can be changed precisely.

BRIEF DESCRIPTION OF DRAWINGS

The figures depict one or more implementation in accordance with the present teaching, by way of example only, not by way of limitations. In the figures, like reference numerals refer to the same or similar elements: where.

DETAILED DESCRIPTION

First Embodiment

Hereinafter, a lighting device 10 according to the present embodiment will be described with reference to FIGS. 1 to 6.

The lighting device 10 is a lighting device configured to light a light source 20, for example, and is a semiconductor light emitting device driving apparatus. The lighting device 10 is configured to control light output of the light source 20.

The light source 20 includes two or more solid-state light emitting devices 21 (see FIG. 6), for example. A light emitting diode (an LED) or the like can be employed as the solid-state light emitting device 21, for example.

When the LED is employed as the solid-state light emitting device 21, the LED may be configured to directly emit light that is emitted from an LED chip. When the LED is employed as the solid-state light emitting device 21, alternatively, the LED may be configured to convert wavelength of part of light that is emitted from the LED chip by a wavelength conversion member, and to emit mixed light of the light emitted from the LED chip and the light emitted from the wavelength conversion member, for example.

In the light source 20, the solid-state light emitting device 21 is configured to emit white light, but the color of the light of the solid-state light emitting device 21 is not specifically limited thereto. In the light source 20, an electrical connection relationship of the solid-state light emitting devices 21 is a series connection, but the connection relationship thereof is not limited thereto. For example, the connection relationship may be a parallel connection or a combination of a series connection(s) and a parallel connection(s). In the light source 20, the number of solid-state light emitting devices 21 is more than one, but the number thereof may be one. In the light source 20, the solid-state light emitting device 21 is an LED, but the solid-state light emitting device 21 is not limited thereto. For example, the solid-state light emitting device 21 may be a semiconductor laser device, an organic electroluminescent device, or the like.

Figure 1:
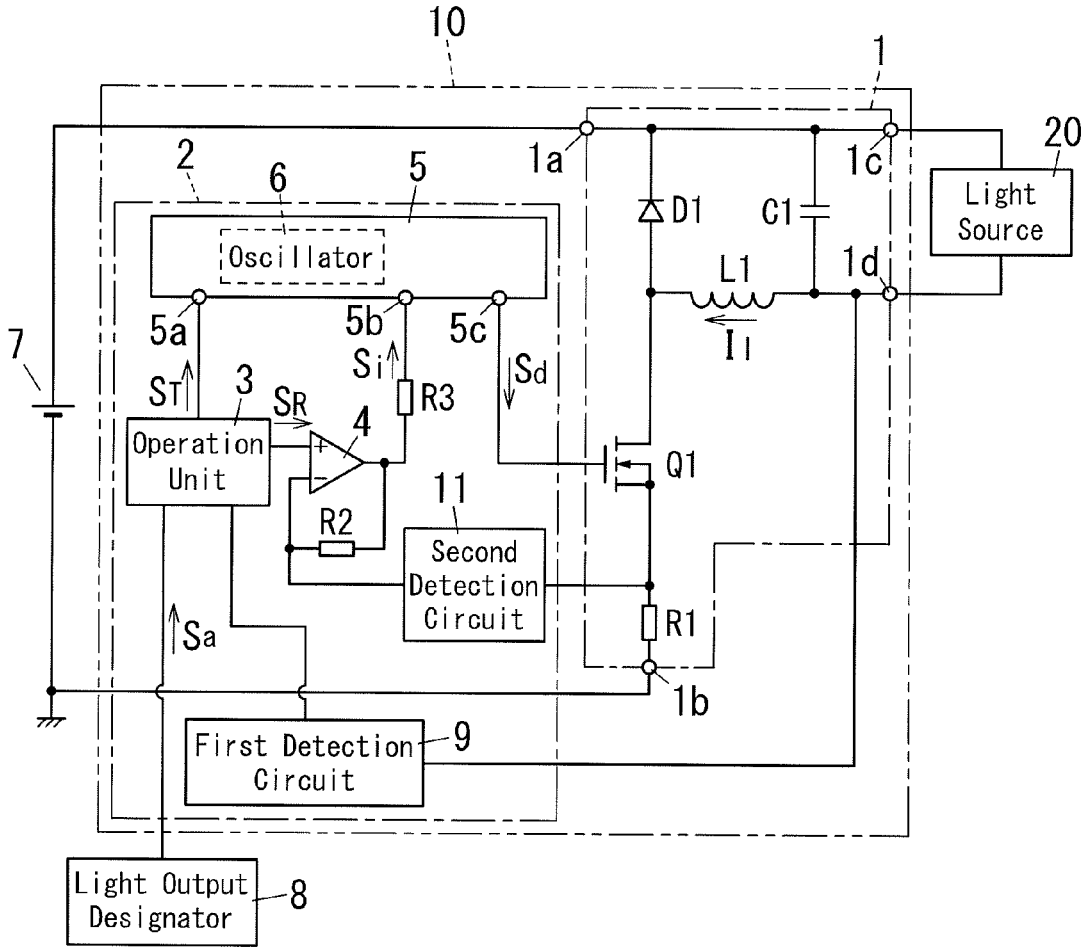
FIG. 1 is a circuit diagram of a luminaire including a lighting device according to a First Embodiment.

As shown in FIG. 1, the lighting device 10 includes a step-down chopper circuit 1 configured to step down an input DC voltage to a DC voltage to be supplied to the light source 20, and a controller 2 configured to control the step-down chopper circuit 1.

A power supply 7 that is configured to supply a DC voltage to the step-down chopper circuit 1 is provided at an input side (upstream) of the step-down chopper circuit 1. A DC power supply or the like can be employed as the power supply 7, for example. Note that the lighting device 10 does not include the power supply 7 as the constituent element. The DC power supply is employed as the power supply 7 in the lighting device 10, but the power supply 7 is not limited thereto. For example, the power supply 7 may be a power supply device configured to convert an AC voltage from a commercial power supply into a DC voltage.

The step-down chopper circuit 1 includes two input ports 1*a* and 1*b* (a high potential side input port 1*a* and a low potential side input port 1*b*), a switching device Q1, a diode (a first diode) D1, an inductor L1, a capacitor (a first capacitor; an output capacitor) C1, and two output ports 1*c* and 1*d* (a high potential side output port 1*c* and a low potential side output port 1*d*).

The input port 1*a* is electrically connected to a high potential side of the power supply 7. The input port 1*b* is electrically connected to a low potential side of the power supply 7. In short, the step-down chopper circuit 1 is configured to receive a DC voltage from the power supply 7 that is provided at the input side of the step-down chopper circuit 1. Note that, in the present embodiment, the low potential side of the power supply 7 is grounded.

A field-effect transistor or the like can be employed as the switching device Q1, for example. A MOSFET (Metal Oxide Semiconductor Field Effect Transistor) or the like can be adopted as the field-effect transistor. In the lighting device 10, a normally-off type n-channel MOSFET is employed as the switching device Q1, for example.

A cathode of the first diode D1 is electrically connected to the input port 1*a*. The cathode of the first diode D1 is also electrically connected to a first end of the inductor L1 via the first capacitor C1. That is, the input port 1*a* is electrically connected to a junction of the cathode of the first diode D1 and the first capacitor C1. A second end of the inductor L1 is electrically connected to an anode of the first diode D1.

A drain of the switching device Q1 is electrically connected to the anode of the first diode D1. The drain of the switching device Q1 also is electrically connected to the second end of the inductor L1. That is, the second end of the inductor L1 is electrically connected to a junction of the anode of the first diode D1 and the drain of the switching device Q1. A gate of the switching device Q1 is electrically connected to the controller 2. A source of the switching device Q1 is electrically connected to the input port 1*b* via a resistor (a first resistor) R1. In the lighting device 10, the switching device Q1 is arranged at a low potential side of the step-down chopper circuit 1. In detail, in the step-down chopper circuit 1, the switching device Q1 is arranged at a low potential side compared to the inductor L1. That is, the switching device Q1 constitutes a low side switching device.

The first resistor R1 is a resistor for detecting a current flowing through the switching device Q1 (a drain current of switching device Q1). A voltage across the first resistor R1 is detected as a voltage proportional to a drain current of the switching device Q1. Note that in the following, for convenience of the description, the voltage proportional to the drain current of the switching device Q1 (namely, the voltage across the first resistor R1) is also referred to as "a detection voltage".

A high potential side of the first capacitor C1 is electrically connected to the output port 1*c*. A low potential side of the first capacitor C1 is electrically connected to the output port 1*d*. In the lighting device 10, the output port 1*c* is electrically connected to a side of an anode of the light source 20. In the lighting device 10, the output port 1*d* is electrically connected to a side of a cathode of the light source 20. Accordingly, in the lighting device 10, the light source 20 can be lighted by the DC voltage that is generated by the step-down chopper circuit 1.

The controller 2 is configured to turn on and off the switching device Q1 at a fixed frequency (25 kHz, for example). To be specific, the controller 2 includes a first detection circuit 9, a second detection circuit 11, an operation unit 3, an output unit 4, and a control circuit 5. The first detection circuit 9 is configured to detect a forward voltage of the light source 20. The second detection circuit 11 is configured to detect an average value of the detection voltage detected through the first resistor R1. The operation unit 3 is configured to determine a reference voltage value based on: a light output level designated by a light output control signal Sa that instructs a light output of the light source 20; and the forward voltage of the light source 20 The output unit 4 is configured to output, as a difference signal Si, a difference between the reference voltage value determined by the operation unit 3 and the average value of the detection voltage. The control circuit 5 is configured to determine an on-time period of the switching device Q1. Also, the controller 2 includes one or more (two in the present embodiment) resistors R2 and R3. In the present embodiment, the forward voltage of the light source 20 (that is detected through the first detection circuit 9) indicates a sum of forward voltages of the solid-state light emitting devices 21. When solid-state light emitting device 21 is one, the forward voltage of the light source 20 indicates the forward voltage of the one solid-state light emitting device 21. Note that in the following, for convenience of the description, the resistor R2 is referred to as a second resistor R2, and the resistor R3 is referred to as a third resistor R3.

The first detection circuit 9 is electrically connected to the output port 1*d* (the side of the cathode of light source 20) of the step-down chopper circuit 1. The first detection circuit 9 is electrically connected to the operation unit 3. The first detection circuit 9 is also electrically connected (not shown) to the input port 1*a* of the step-down chopper circuit 1. Accordingly, the first detection circuit 9 can detect the voltage difference between the input port 1*a* and the output port 1*d* of the step-down chopper circuit 1, and thus can detect the forward voltage of the light source 20. In the present embodiment, the first detection circuit 9 is electrically connected to the input port 1*a* and the output port 1*d* of the step-down chopper circuit 1 in order to detect the forward voltage of the light source 20, but it is not specifically limited thereto. For example, the first detection circuit 9 may be connected to the output ports 1*c* and 1*d* of the step-down chopper circuit 1.

The second detection circuit 11 is configured to average the detection voltages detected through the first resistor R1. To be specific, an integration circuit, which includes a resistor and a capacitor, or the like, can be employed as the second detection circuit 11, for example. An input port of the second detection circuit 11 is electrically connected to the source of the switching device Q1 (namely, a junction of the source of the switching device Q1 and the first resistor R1), thereby obtaining the detection voltage. An output port of the second detection circuit 11 is electrically connected to the output unit 4.

An MPU (Micro Processing Unit) or the like can be employed as the operation unit 3, for example. The operation unit 3 is configured to receive the forward voltage of the light source 20 detected by the first detection circuit 9. The operation unit 3 is also configured to receive a light output control signal Sa from a light output designator 8, for example. A PWM (Pulse Width Modulation) signal or the like can be employed as the light control signal, for example. The frequency of the PWM signal is set to 1 kHz, for example. Note that the lighting device 10 does not include the light output designator 8 as a constituent element.

The operation unit 3 is configured to recognize (obtain) the light output level designated by the light output control signal Sa from the light output designator 8. When the PWM signal is used as the light output control signal Sa, the operation unit 3 includes a clocking unit (not shown) configured to clock a high level period per one cycle of the light output control signal Sa from the light output designator 8, for example. A counter (not shown) incorporated in the MPU that functions as the operation unit 3, or the like, can be employed as the clocking unit, for example. Accordingly, the operation unit 3 can recognize (obtain) the light output level (an on-duty ratio; a duty cycle) designated by the light output control signal Sa from the light output designator 8.

Figure 2:
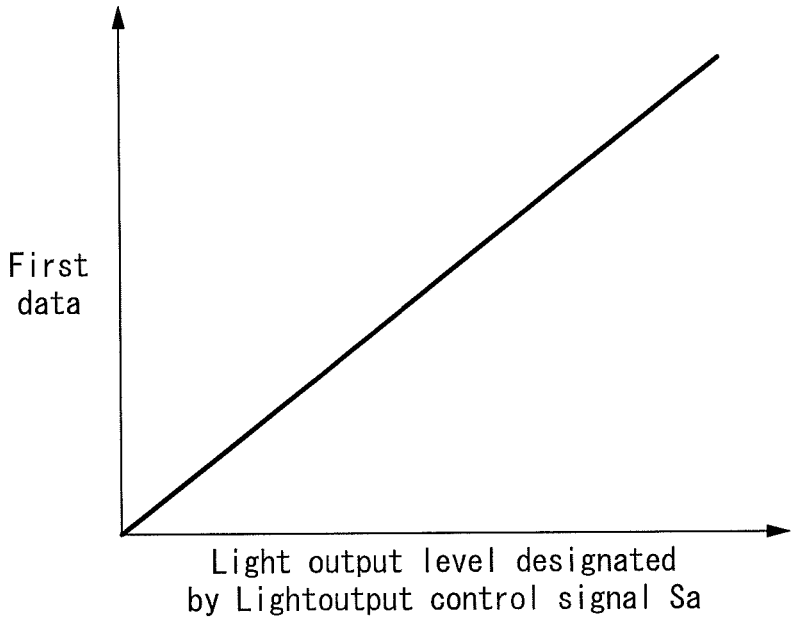
FIG. 2 is a diagram showing a correlation between a light output level designated by a light output control signal and first data for determining a reference voltage value, with respect to the lighting device according to the First Embodiment.

The operation unit 3 is also configured to select, based on the light output level designated by the light output control signal Sa from the light output designator 8, first data for determining the reference voltage value. To be specific, first correlation data (as shown in FIG. 2), in which the light output level is associated with the first data, is stored in a first storage (not shown) provided in the operation unit 3. Accordingly, the operation unit 3 can select first data corresponding to a light output level designated by a light output control signal Sa from the light output designator 8, according to the first correlation data that is pre-stored in the first storage.

Figure 3:
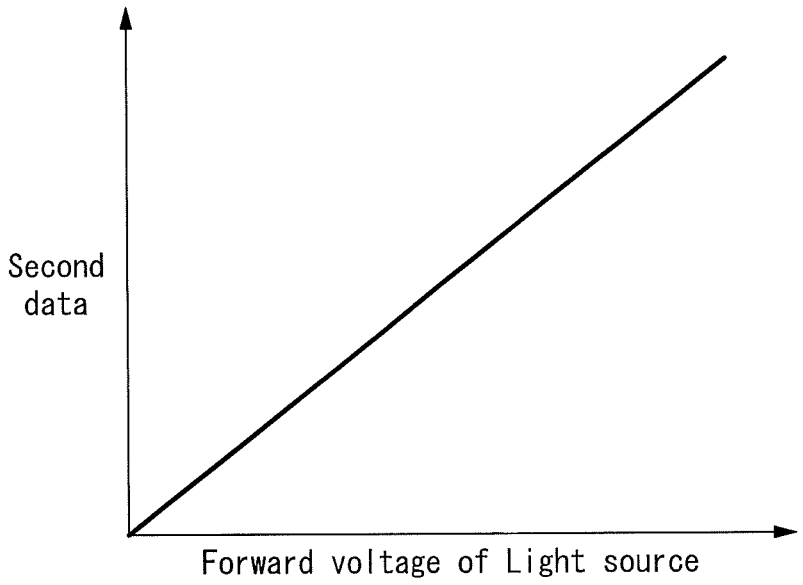
FIG. 3 is a correlation diagram between a forward voltage of a light source and second data for determining the reference voltage value, with respect to the lighting device according to the First Embodiment.

The operation unit 3 is also configured to select, based on the forward voltage of the light source 20 detected by the first detection circuit 9, second data for determining the reference voltage value. To be specific, second correlation data (as shown in FIG. 3), in which the forward voltage is associated with the second data, is stored in the first storage of the operation unit 3. Accordingly, the operation unit 3 can select second data corresponding to a forward voltage of the light source 20 detected by the first detection circuit 9, according to the second correlation data that is pre-stored in the first storage. In the lighting device 10, each of the first correlation data and the second correlation data is stored in the first storage of the operation unit 3, but it is not limited thereto. For example, the lighting device 10 may further include a storage device or the like as a constituent element of the lighting device 10, and the first correlation data and the second correlation data may be stored in this storage device.

The operation unit 3 is configured to multiply the selected first data and the selected second data. The operation unit 3 is also configured to determine the result of multiplying the first data and the second data as the reference voltage value. The operation unit 3 is also configured to output, to the output unit 4, a reference voltage signal $S_R$ corresponding to the reference voltage value.

Note that, in a case where the light source 20 is formed of solid-state light emitting devices as in the present embodiment, the forward voltage of the light source 20 is substantially constant independent of a current flowing through the light source 20 (i.e., independent of light intensity of the light source 20). Therefore, in this case, the reference voltage value is determined substantially by the light output level designated by the light output control signal Sa.

Figure 4:
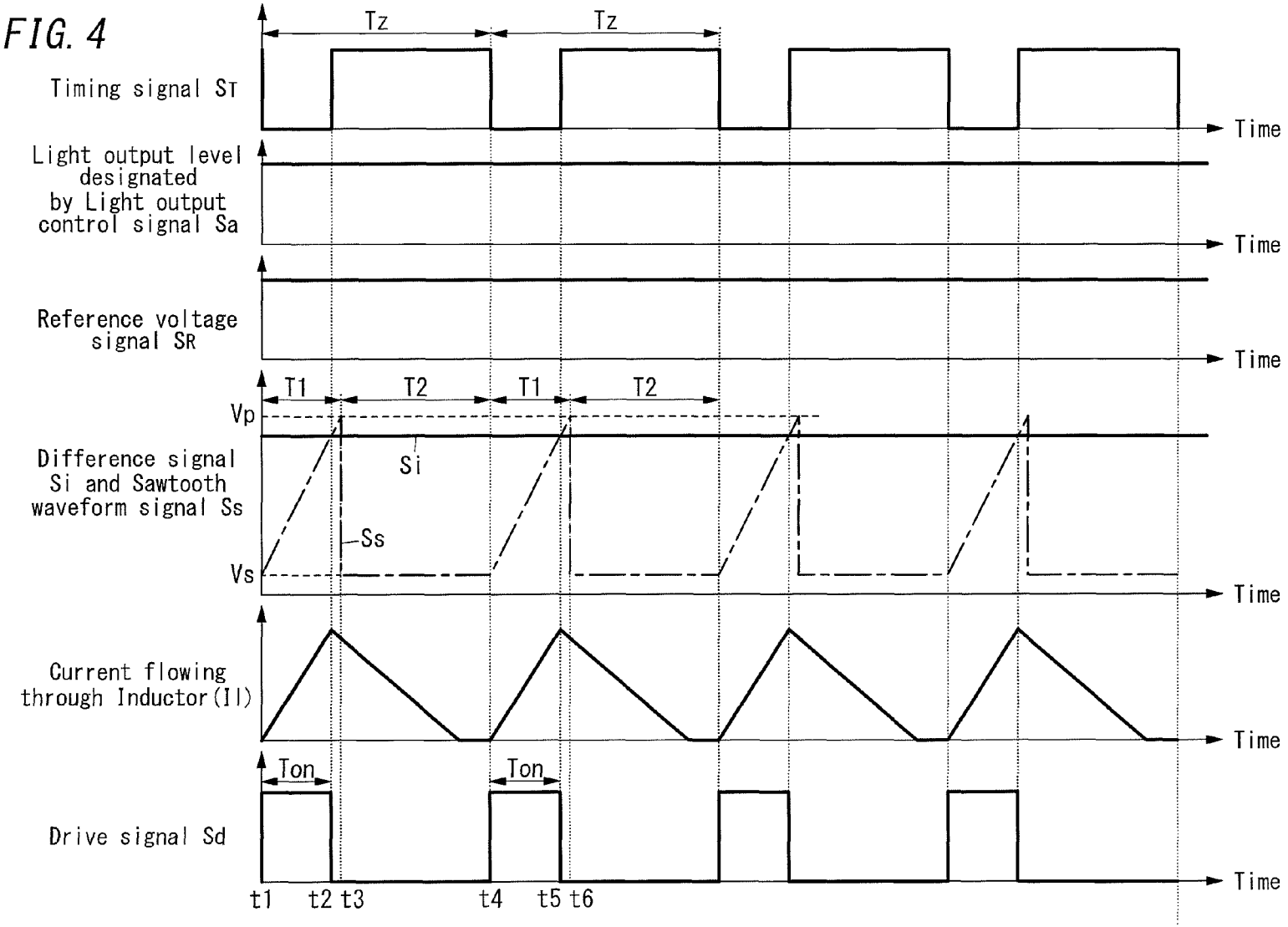
FIG. 4 is a timing chart for describing an operation of the lighting device according to the First Embodiment.
Figure 5:
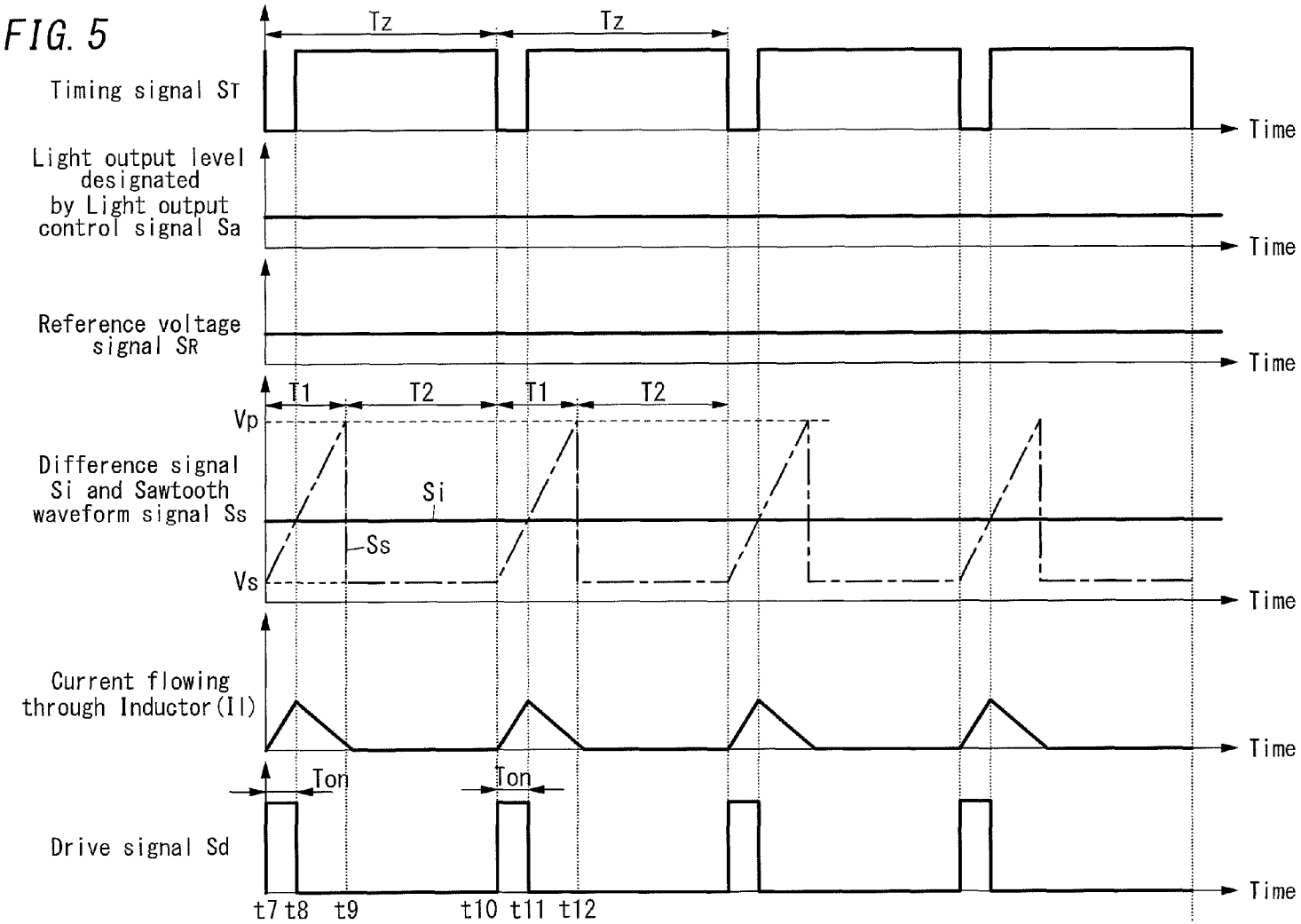
FIG. 5 is another timing chart for describing an operation of the lighting device according to the First Embodiment.

The operation unit 3 is also configured to output, to the control circuit 5, a timing signal $S_T$ that causes the control circuit 5 to turn on the switching device Q1. A rectangular wave signal or the like can be used as the timing signal, for example. The timing signal $S_T$ has a fixed frequency (25 kHz, for example). The operation unit 3 is configured to change the timing signal $S_T$ from a high level to a low level at the end of a fixed period (40 μs, for example). Note that "Tz" in FIGS. 4 and 5 shows the above fixed period.

An error amplifier or the like can be employed as the output unit 4, for example. A non-inverting input terminal of the output unit 4 is electrically connected to the operation unit 3. An inverting input terminal of the output unit 4 is electrically connected to the second detection circuit 11. The inverting input terminal of the output unit 4 is also electrically connected to the output terminal of the output unit 4 via the second resistor R2. The output terminal of the output unit 4 is electrically connected to the control circuit 5 via the third resistor R3.

The control circuit 5 is configured to control ON and OFF of the switching device Q1. A control IC (Integrated Circuit) for controlling the step-down chopper circuit 1 or the like can be employed as the control circuit 5, for example.

The control circuit 5 includes a gate driver (not shown) configured to drive the gate of the switching device Q1. The gate driver is configured to output, to the gate of the switching device Q1, a drive signal Sd for driving the gate of the switching device Q1. The control circuit 5 switches the drive signal Sd of the gate driver from a low level to a high level in order to change the state of the switching device Q1 from an off-state to an on-state. The control circuit 5 switches the drive signal Sd of the gate driver from the high level to the low level in order to change the state of the switching device Q1 from the on-state to the off-state.

The control circuit 5 also includes a first input terminal 5*a* for receiving the timing signal $S_T$ from the operation unit 3, a second input terminal 5*b* for receiving the difference signal Si from the output unit 4, and an output terminal 5*c* for outputting the drive signal Sd of the gate driver. The first input terminal 5*a* is electrically connected to the operation unit 3. The second input terminal 5*b* is electrically connected to the output terminal of the output unit 4 via the third resistor R3. The output terminal 5*c* is electrically connected to the gate of the switching device Q1.

The control circuit 5 is configured to switch the drive signal Sd from the output terminal 5*c* from the low level to the high level when the timing signal $S_T$ that is inputted to the first input terminal 5*a* is changed from the high level to the low level (see FIGS. 4 and 5). Accordingly, in the lighting device 10, the state of the switching device Q1 can be changed from the off-state to the on-state.

The control circuit 5 includes an oscillator 6 configured to generate a voltage signal Ss shaped like teeth of a saw. Note that hereinafter, for convenience of the description, the voltage signal Ss is also referred to as a saw-toothed signal Ss.

As shown by dashed-dotted lines in FIGS. 4 and 5, the saw-toothed signal Ss includes, for every fixed period Tz, a first period T1 during which the output level thereof increases at a fixed rate and a second period T2 during which the output level thereof is kept at a pre-set minimum value Vs. The minimum value Vs is, for example, stored in a second storage (not shown) provided in the control IC that functions as the control circuit 5, but it is not limited thereto. For example, the minimum value Vs may be stored in the aforementioned storage device or the like.

The control circuit 5 is configured so that the level of the saw-toothed signal Ss starts increasing upon the timing signal $S_T$ inputted to the first input terminal 5*a* changing from the high level to the low level. That is, the control circuit 5 is configured to start increasing the level of the saw-toothed signal Ss of the oscillator 6 at the same time as the control circuit 5 switches the drive signal Sd from the low level to the high level. The control circuit 5 is also configured to determine the on-time period Ton (see FIGS. 4 and 5) of the switching device Q1 based on the level of the saw-toothed signal Ss generated by the oscillator 6 and the level of the difference signal Si supplied from the output unit 4. To be specific, the control circuit 5 is configured to turn off the switching device Q1 when the level of the saw-toothed signal Ss generated by the oscillator 6 reaches the level of the difference signal Si supplied from the output unit 4. Accordingly, in the lighting device 10, the state of the switching device Q1 can be changed from the on-state to the off-state.

The control circuit 5 is also configured so that the level of the saw-toothed signal Ss is changed to the minimum value Vs when the level of the saw-toothed signal Ss reaches a pre-set maximum value Vp (see FIGS. 4 and 5). The maximum value Vp is stored in the second storage of the control IC that functions as the control circuit 5, for example, but it is not limited thereto. For example, the maximum value Vp may be stored in the aforementioned storage device or the like.

That is, the saw-toothed signal Ss has a fixed frequency 1/Tz. The saw-toothed signal Ss has, at the start of every period Tz, the first period T1 during which the output level thereof increases at the fixed rate from the pre-set minimum value Vs. In the saw-toothed signal Ss of the embodiment, in each period Tz, the first period T1 is followed by the second period T2 during which the output level thereof is kept at the minimum value Vs. Note that, the saw-toothed signal Ss is, for example, a voltage across a capacitor. During the first periods T1, the control circuit 5 supplies a constant current, thereby linearly increasing the level of the saw-toothed signal Ss.

The control IC is employed as the control circuit 5 in the lighting device 10, but it is not limited thereto. For example, a microcomputer or the like may be employed as the control circuit 5 in the lighting device 10. When a microcomputer is employed as the control circuit 5, an operation unit provided in the microcomputer can be used as the operation unit 3. Accordingly, the control circuit 5 and the operation unit 3 can be formed integrally in the lighting device 10, and it is possible to downsize the lighting device 10 compared with a case where the control circuit 5 and the operation unit 3 are formed separately.

Hereinafter, an example of an operation of the lighting device 10 according to the present embodiment will be described with reference to FIG. 4. In the example of FIG. 4, the lighting device 10 controls the light source 20 such that the light therefrom is at a certain light output level (referred to as "a first light output level").

The control circuit 5 switches the drive signal Sd from the output terminal 5*c* from the low level to the high level, when the timing signal $S_T$ inputted to the first input terminal 5*a* changes from the high level to the low level (at times t1, t4, and the like in FIG. 4). The state of the switching device Q1 thereby changes from the off-state to the on-state. In the lighting device 10, when the state of the switching device Q1 is changed from the off-state to the on-state, a current flows from the power supply 7 through a path of the light source 20 (the first capacitor C1), the inductor L1, and the switching device Q1. Accordingly, in the lighting device 10, the current $I_1$ flowing through the inductor L1 increases gradually, and electromagnetic energy is accumulated in the inductor L1.

The control circuit 5 starts increasing the level of the saw-toothed signal Ss of the oscillator 6 at the fixed rate, when the timing signal $S_T$ inputted to the first input terminal 5*a* changes from the high level to the low level.

The control circuit 5 switches the drive signal Sd of the gate driver from the high level to the low level, when the level of the saw-toothed signal Ss generated by the oscillator 6 reaches the level of the difference signal Si supplied from the output unit 4 (at times t2, t5, and the like in FIG. 4). The state of the switching device Q1 thereby changes from the on-state to the off-state. In the lighting device 10, when the state of the switching device Q1 changes from the on-state to the off-state, the electromagnetic energy stored in the inductor L1 is discharged and the current $I_1$ flowing through the inductor L1 decreases gradually. In the lighting device 10, the timing signal $S_T$ may be changed from the low level to the high level, when the state of the switching device Q1 changes from the on-state to the off-state. However, the operation unit 3 may be configured to change the timing signal $S_T$ from the low lever to the high level at any time independent of an operation of the control circuit 5.

The control circuit 5 changes the level of the saw-toothed signal Ss to the minimum value Vs, when the level of the saw-toothed signal Ss generated by the oscillator 6 reaches a pre-set maximum value Vp (at times t3, t6, and the like in FIG. 4).

The operation unit 3 switches the timing signal $S_T$ from the high level to the low level at the end of the fixed period Tz (namely, at the start of next period Tz).

As described above, the lighting device 10 according to the present embodiment is a lighting device configured to control light output of the light source 20 including the solid-state light emitting devices 21. The lighting device 10 includes the step-down chopper circuit 1 configured to step down an input DC voltage to a DC voltage to be supplied to the light source 20, and the controller 2 configured to control the step-down chopper circuit 1. The controller 2 is configured to turn the low-side switching device Q1 in the step-down chopper circuit 1 on and off at a fixed frequency. The controller 2 includes the operation unit 3, the output unit 4 and the control circuit 5. The operation unit 3 is configured to determine the reference voltage value based on: the light output level designated by the light output control signal Sa that instructs the light output of the light source 20; and the forward voltage of the light source 20. The output unit 4 is configured to output, as the difference signal Si, the difference between the reference voltage value determined by the operation unit 3 and the average value of the voltage that is proportional to the current flowing through the switching device Q1. The control circuit 5 is configured to determine the on-time period of the switching device Q1. The control circuit 5 includes the oscillator 6 configured to generate a voltage signal Ss shaped like teeth of a saw. The control circuit 5 is configured to determine the on-time period of the switching device Q1 based on the level of the voltage signal generated by the oscillator 6 and the level of the difference signal Si supplied from the output unit 4.

In the lighting device 10, the on-time period of the switching device Q1 is determined based on the voltage signal generated by the oscillator 6. Accordingly, in the lighting device 10, the on-time period Ton of the switching device Q1 can be changed more precisely compared with the conventional lighting device 81.

The control circuit 5 is configured to turn off the switching device Q1 when the level of the voltage signal generated by the oscillator 6 reaches the level of the difference signal Si supplied from the output unit 4. Accordingly, in the lighting device 10, the on-time period Ton of the switching device Q1 can be changed more precisely compared with the conventional lighting device 81.

Hereinafter, another example of an operation of the lighting device 10 according to the present embodiment will be described with reference to FIG. 5. In the example of FIG. 5, the lighting device 10 controls the light source 20 such that the light therefrom is at a second light output level. Note that, a description will be given assuming that the second light output level is smaller than the first light output level.

The control circuit 5 switches the drive signal Sd from the output terminal 5*c* from the low level to the high level, when the timing signal $S_T$ inputted to the first input terminal 5*a* changes from the high level to the low level (at times t7, t10, and the like in FIG. 5). The state of the switching device Q1 thereby changes from the off-state to the on-state. In the lighting device 10, when the state of the switching device Q1 is changed from the off-state to the on-state, a current flows from the power supply 7 through a path of the light source 20 (the first capacitor C1), the inductor L1, and the switching device Q1. Accordingly, in the lighting device 10, the current $I_1$ flowing through the inductor L1 increases gradually, and electromagnetic energy is accumulated in the inductor L1.

The control circuit 5 starts increasing the level of the saw-toothed signal Ss of the oscillator 6 at the fixed rate, when the timing signal $S_T$ inputted to the first input terminal 5*a* changes from the high level to the low level.

The control circuit 5 switches the drive signal Sd of the gate driver from the high level to the low level, when the level of the saw-toothed signal Ss generated by the oscillator 6 reaches the level of the difference signal Si supplied from the output unit 4 (at times t8, t11, and the like in FIG. 5). The state of the switching device Q1 thereby changes from the on-state to the off-state. In the lighting device 10, when the state of the switching device Q1 changes from the on-state to the off-state, the electromagnetic energy stored in the inductor L1 is discharged and the current $I_1$ flowing through the inductor L1 decreases gradually. In the lighting device 10, for example, the timing signal $S_T$ is changed from the low level to the high level, when the state of the switching device Q1 changes from the on-state to the off-state.

The control circuit 5 changes the level of the saw-toothed signal Ss to the minimum value Vs, when the level of the saw-toothed signal Ss generated by the oscillator 6 reaches a pre-set maximum value Vp (at times t9, t12, and the like in FIG. 5).

The operation unit 3 switches the timing signal $S_T$ from the high level to the low level at the end of the fixed period Tz (namely, at the start of next period Tz).

In the lighting device 10 according to the present embodiment, the on-time period Ton of the switching device Q1 can be changed by changing the light output level designated by the light output control signal Sa of the light output designator 8, for example, from the first light output level to the second light output level. That is, in the lighting device 10, the on-time period Ton of the switching device Q1 can be changed according to the level of the difference signal Si supplied from the output unit 4.

Figure 17:
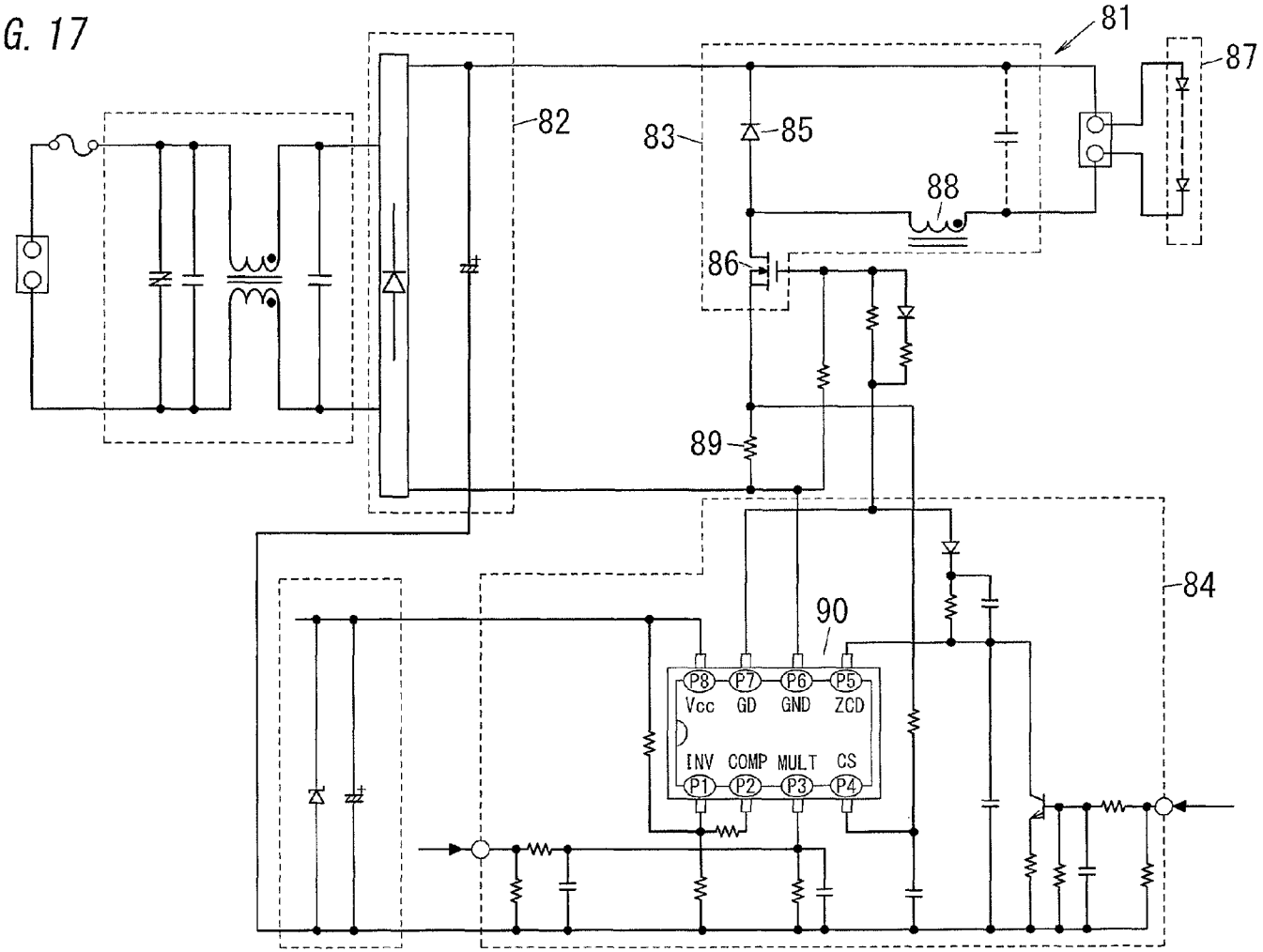
FIG. 17 is a circuit diagram of a luminaire including a lighting device according to a conventional example.

Incidentally, in the conventional lighting device 81 having the configuration shown in FIG. 17, the control circuit 84 is configured to turn off the switching device 86 based on the chopper current detected through the fourth pin P4 of the integrated circuit 90. As described above, the fourth pin P4 of the integrated circuit 90 is electrically connected to the noise filter (the RC circuit) which is formed of a resistor and a capacitor and is provided in the integrated circuit 90. In contrast, in the lighting device 10 according to the present embodiment, the control circuit 5 turns off the switching device Q1 based on the level of the saw-toothed signal Ss generated by the built-in oscillator 6. Accordingly, in the lighting device 10, it is possible to suppress generation of a delay when the switching device Q1 is turned off, compared with the conventional lighting device 81, and it is possible to change the on-time period Ton of the switching device Q1 more precisely. Accordingly, in the lighting device 10, light output of the light source 20 can be controlled at a lower light output level (as small as a light output level in a range from 1 to 5 [%], for example) compared with the conventional lighting device 81.

Figure 6:
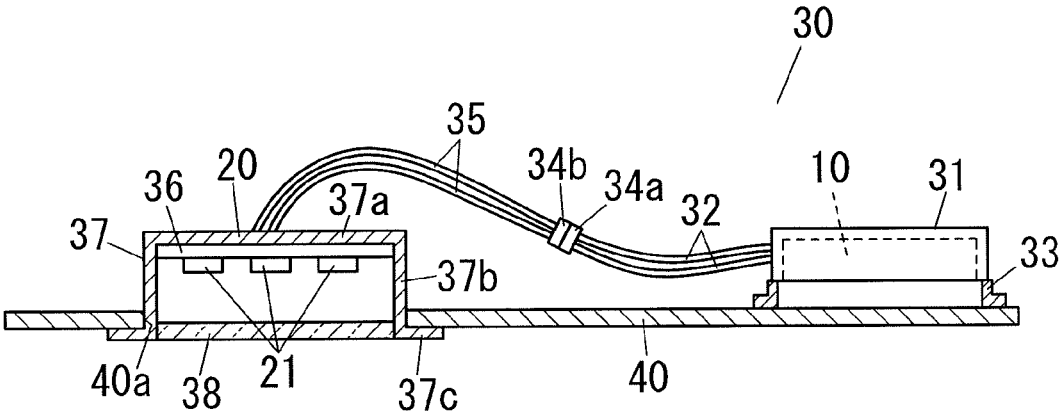
FIG. 6 is a schematic cross-section of the luminaire according to the First Embodiment.

Hereinafter, an example of a luminaire 30 including the lighting device 10 according to the present embodiment will be described with reference to FIG. 6.

The luminaire 30 is a luminaire configured to be embedded in a ceiling material 40. The luminaire 30 includes the light source 20, the lighting device 10 configured to light the light source 20, and a casing 31 for housing the lighting device 10.

The casing 31 is shaped like a rectangular box, for example. A metal (such as iron, aluminum, or stainless-steel) or the like can be employed as the material of the casing 31, for example. The casing 31 is arranged on a side of an upper face of the ceiling material 40. A spacer 33 is interposed between the casing 31 and the ceiling material 40. The spacer 33 maintains a space between the casing 31 and the ceiling material 40 at a predetermined distance.

The casing 31 has a first side wall (a left side wall in FIG. 6) in which a first lead-out hole (not shown) is formed for leading out a first connection line 32 that is electrically connected to the lighting device 10. The lighting device 10 is electrically connected to an output connector 34*a* via the first connection line 32.

The luminaire 30 includes a substrate 36 on which two or more solid-state light emitting devices 21 are mounted, and a luminaire body 37 to which the substrate 36 is attached.

A metal base print wiring board or the like can be employed as the substrate 36, for example. In the luminaire 30, an outer periphery of the substrate 36 is shaped like a circle for example. In the luminaire 30, a plane size of the substrate 36 is smaller than a size of an opening (a lower opening) of the luminaire body 37.

The substrate 36 is electrically connected to an input connector 34*b* via a second connection line 35. The input connector 34*b* is detachably connected to the output connector 34*a*. In the luminaire 30, the lighting device 10 and the substrate 36 are electrically connected with each other by connecting the output connector 34*a* and the input connector 34*b*.

The substrate 36 has a first face (a lower face in FIG. 6) on which the solid-state light emitting devices 21 are mounted. Note that three solid-state light emitting devices 21 in the solid-state light emitting devices 21 are illustrated in FIG. 6.

The luminaire body 37 is shaped like a hollow cylinder having a top base, for example. A metal (such as iron, aluminum, or stainless-steel) or the like can be employed as the material of the luminaire body 37, for example.

The luminaire body 37 has a top face 37*a* in which a second lead-out hole (not shown) is formed for leading out the second connection line 35 that is electrically connected to the substrate 36. In the luminaire 30, the substrate 36 is arranged in an inside of the luminaire body 37. In the luminaire 30, the substrate 36 is attached to the top base 37*a* of the luminaire body 37. An adhesive sheet (not shown) or the like can be employed as a means for attaching the substrate 36 to the top base 37*a* of the luminaire body 37, for example. It is preferable that the adhesive sheet have electrical insulation property and thermal conductivity.

The luminaire body 37 has a side wall 37*b* and a flange portion 37*c* extending sideway from a lower end portion of the side wall 37*b*. Two metal attachment fittings (not shown) are provided at right and left sides of a lower end portion of the side wall 37*b* of the luminaire body 37. The two metal attachment fittings are configured so that portions of the ceiling material 40 around an embedding hole 40*a*, which is provided in the ceiling material 40, are clamped between the metal attachment fittings and the flange portion 37*c*. In the luminaire 30, the luminaire body 37 can be embedded in the ceiling material 40, by clamping the portions of the ceiling material 40 around the embedding hole 40*a* with the metal attachment fittings and the flange portion 37*c*.

The luminaire 30 further includes a diffusion plate 38 that diffuses light emitted from the solid-state light emitting devices 21. The diffusion plate 38 is formed so as to cover the opening of the luminaire body 37. An optically transparent material (such as acrylic resin or glass) or the like can be employed as the material of the diffusion plate 38. In the luminaire 30, the diffusion plate 38 has a disk-like shape, for example. In the luminaire 30, the diffusion plate 38 is detachably attached to a lower end portion of the side wall 37*b* of the luminaire body 37.

The luminaire 30 according to the present embodiment described above includes the light source 20 and the lighting device 10 configured to light the light source 20. Accordingly, it is possible to provide the luminaire 30 including the lighting device 10 that can change the on-time period Ton of the switching device Q1 precisely.

Second Embodiment

Figure 7:
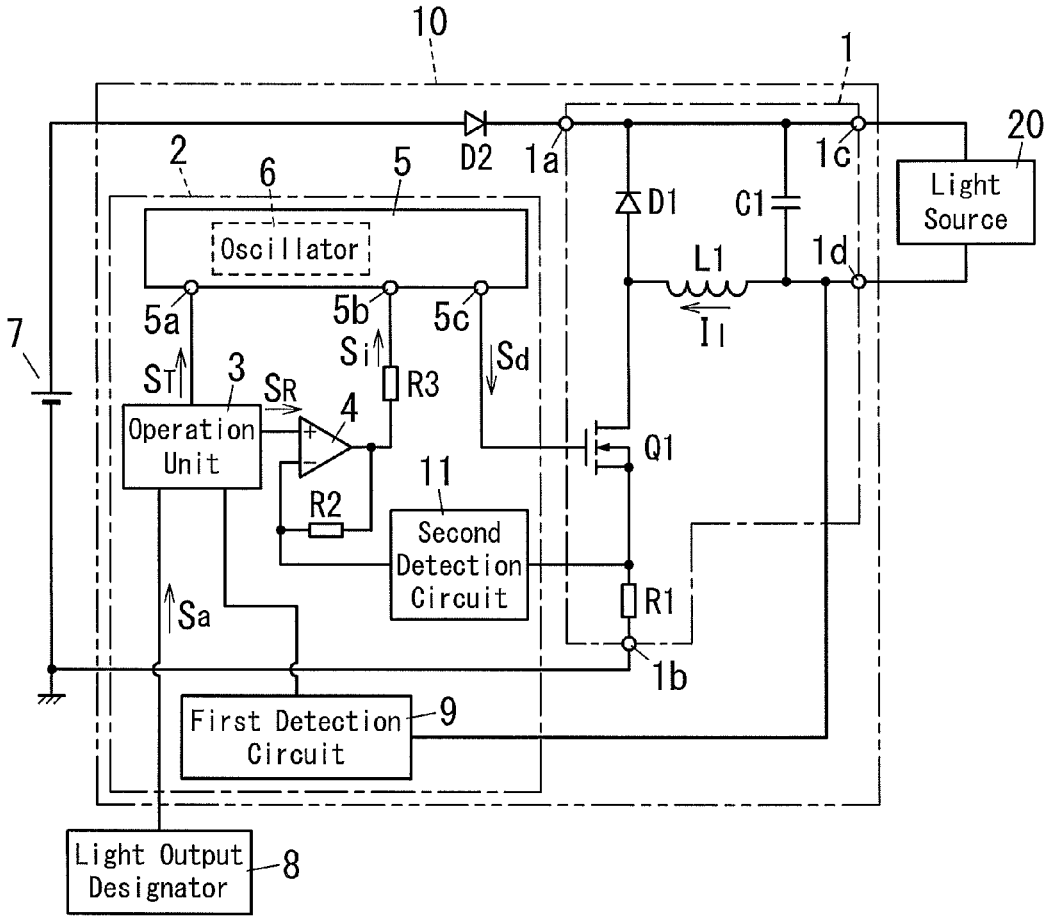
FIG. 7 is a circuit diagram of a luminaire including a lighting device according to a Second Embodiment.

A lighting device 10 according to the present embodiment has the same basic configuration as the First Embodiment, and differs from the First Embodiment in that a second diode D2 that is different from a first diode D1 is provided on an electrical path to an input port 1*a* of a step-down chopper circuit 1, as shown in FIG. 7. Note that, in the present embodiment, constituent elements similar to those in the First Embodiment are provided with the same reference numerals, and description thereof will be omitted as appropriate.

As shown in FIG. 7, an anode of the second diode D2 is electrically connected to a high potential side of a power supply 7. A cathode of the second diode D2 is electrically connected to the input port 1*a* of the step-down chopper circuit 1. In short, in the second diode D2, the anode thereof is connected to the high potential side of the power supply 7 and the cathode thereof is connected to the high potential side input port 1*a* of the step-down chopper circuit 1.

Incidentally, it will be considered a case where the lighting device 10 of the First Embodiment is configured to light the light source 20 at three different light output levels. Hereinafter, these three different light output levels are respectively referred to as a third light output level, a fourth light output level, and a fifth light output level, such that the following relational expression is satisfied: third light output level>fourth light output level>fifth light output level. In this case, the lighting device 10 according to the First Embodiment has three light control modes, for example, a first light control mode in which the lighting device 10 lights the light source 20 at the third light output level, a second light output mode in which the lighting device 10 lights the light source 20 at the fourth light output level, and a third light control mode in which the lighting device 10 lights the light source 20 at the fifth light output level. In this case, for example, the lighting device 10 (an operation unit 3) may be configured to select one light control mode from the first to three light control modes based on a light output level designated by a light output control signal Sa from a light output designator 8. Note that a light control mode indicates an operation mode in which the light output of the light source 20 is controlled (dimmed) by the lighting device 10.

Figure 8:
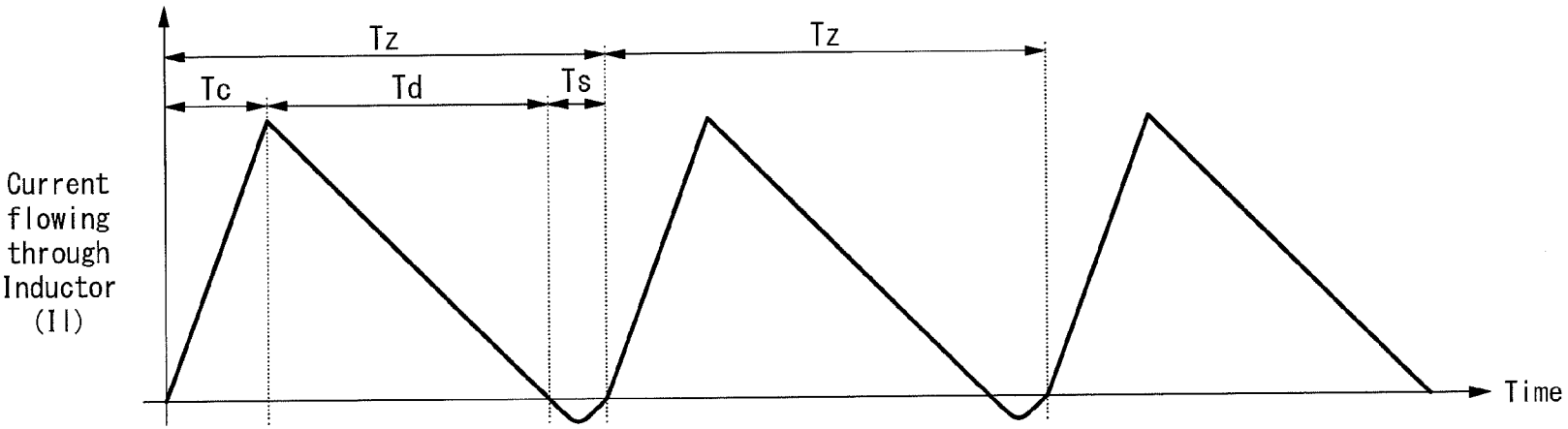
FIG. 8 is a waveform diagram of a current flowing through an inductor in a first light control mode in the lighting device according to the First Embodiment.

In the lighting device 10 according to the First Embodiment, when the first light control mode is selected as the light control mode, a current $I_1$ flowing through an inductor L1 in the step-down chopper circuit 1 changes in a fixed period Tz, as shown in FIG. 8. In FIG. 8, Tc indicates an accumulation period during which electromagnetic energy is accumulated in the inductor L1. Note that, the accumulation period Tc corresponds to an on-time period Ton of the switching device Q1. In FIG. 8, Td indicates a discharge period during which the electromagnetic energy stored in the inductor L1 is discharged. In FIG. 8, Ts indicates a quiescent period during which electromagnetic energy is neither accumulated in nor discharged from the inductor L1.

Figure 9:
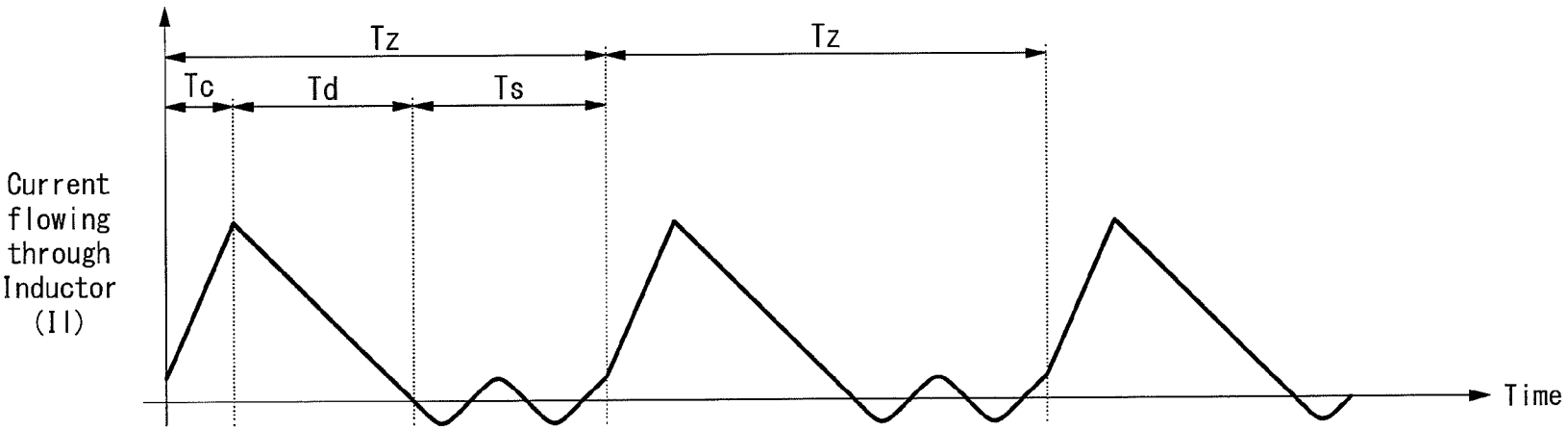
FIG. 9 is a waveform diagram of a current flowing through the inductor in a second light control mode in the lighting device according to the First Embodiment.

In the lighting device 10 according to the First Embodiment, when the second light control mode is selected as the light control mode, a current $I_1$ flowing through the inductor L1 in the step-down chopper circuit 1 changes in the fixed period Tz, as shown in FIG. 9. In FIG. 9, Tc indicates an accumulation period during which electromagnetic energy is accumulated in the inductor L1. In FIG. 9, Td indicates a discharge period during which the electromagnetic energy stored in the inductor L1 is discharged. In FIG. 9, Ts indicates a quiescent period during which electromagnetic energy is neither accumulated in nor discharged from the inductor L1.

Figure 10:
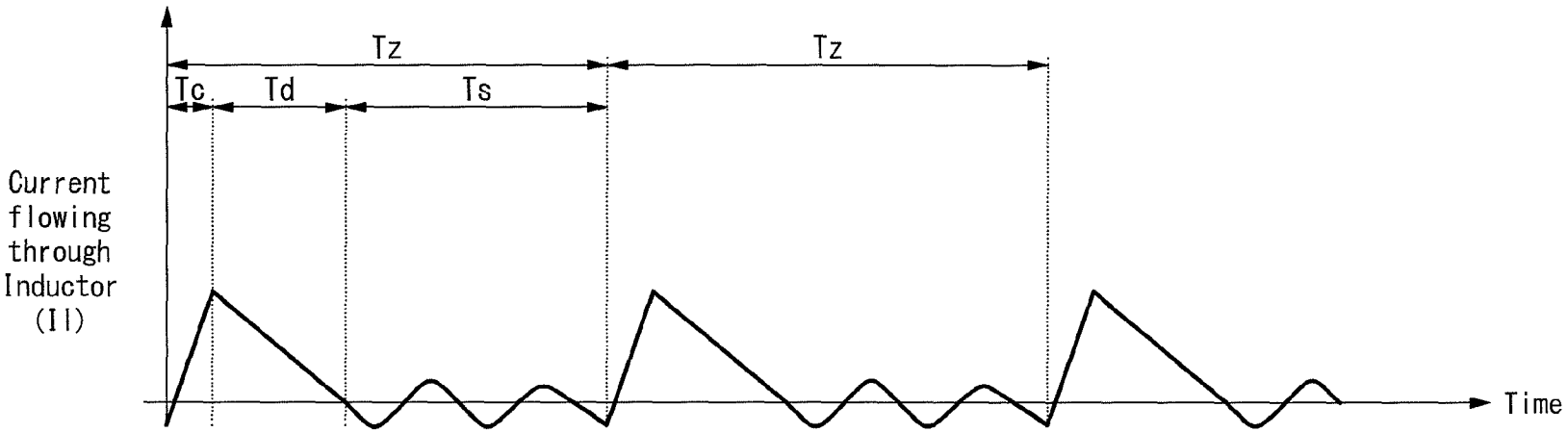
FIG. 10 is a waveform diagram of a current flowing through the inductor in a third light control mode in the lighting device according to the First Embodiment.

In the lighting device 10 according to the First Embodiment, when the third light control mode is selected as the light control mode, a current $I_1$ flowing through the inductor L1 in the step-down chopper circuit 1 changes in the fixed period Tz, as shown in FIG. 10. In FIG. 10, Tc indicates an accumulation period during which electromagnetic energy is accumulated in the inductor L1. In FIG. 10, Td indicates a discharge period during which the electromagnetic energy stored in the inductor L1 is discharged. In FIG. 10, Ts indicates a quiescent period during which electromagnetic energy is neither accumulated in nor discharged from the inductor L1.

In the lighting device 10 according to the First Embodiment, the current $I_1$ flowing through the inductor L1 possibly fluctuates in the quiescent period Ts of the fixed period Tz, as shown in FIGS. 8 to 10, due to, for example, an LC circuit of the inductor L1 and the first capacitor C1 when the lighting device 10 lights the light source 20.

Here, in the lighting device 10 according to the First Embodiment, it is possible to consider a case where, when the light control mode is changed, the current $I_1$ flowing through the inductor L1 is changed at a fixed rate in order to prevent the occurrence of flickering of light emitted from the light source 20. To be specific, in the lighting device 10 according to the First Embodiment, it is possible to consider a case where the current $I_1$ flowing through the inductor L1 is decreased at the fixed rate in a period when the light control mode is changed from the first light control mode to the second light control mode, for example.

Figure 11:
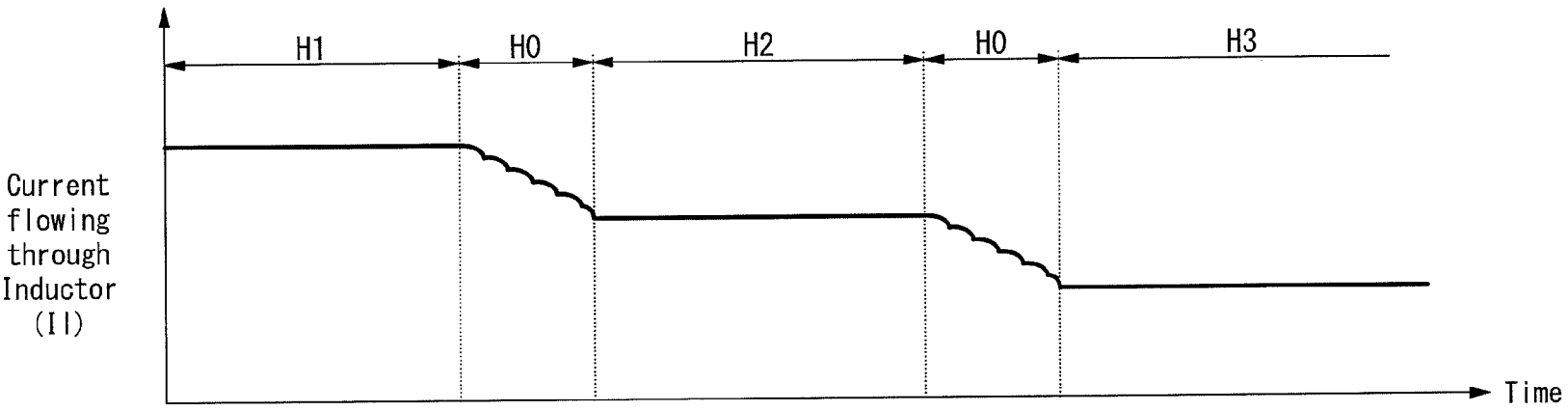
FIG. 11 is a diagram illustrating a change in a current flowing through the inductor when the light control mode is changed in the lighting device according to the First Embodiment.

However, in the lighting device 10 according to the First Embodiment, when the lighting device 10 lights the light source 20, the current $I_1$ flowing through the inductor L1 possibly fluctuates in the quiescent period Ts of the fixed period Tz, as shown in FIGS. 8 to 10. Accordingly, in the lighting device 10 according to the First Embodiment, the current $I_1$ flowing through the inductor L1 will possibly change stepwise, as shown in FIG. 11, when the light control mode is changed (see periods "H0" in FIG. 11). In the lighting device 10 according to the First Embodiment, flickering of light that is emitted from the light source 20 will thereby possibly occur, when the light control mode is changed. Note that, in FIG. 11, H1 indicates a period during which the first light control mode is selected as the light control mode. In FIG. 11, H2 indicates a period during which the second light control mode is selected as the light control mode. In FIG. 11, H3 indicates a period during which the third light control mode is selected as the light control mode. In FIG. 11, H0 indicates periods when the light control mode is changed.

Figure 12:
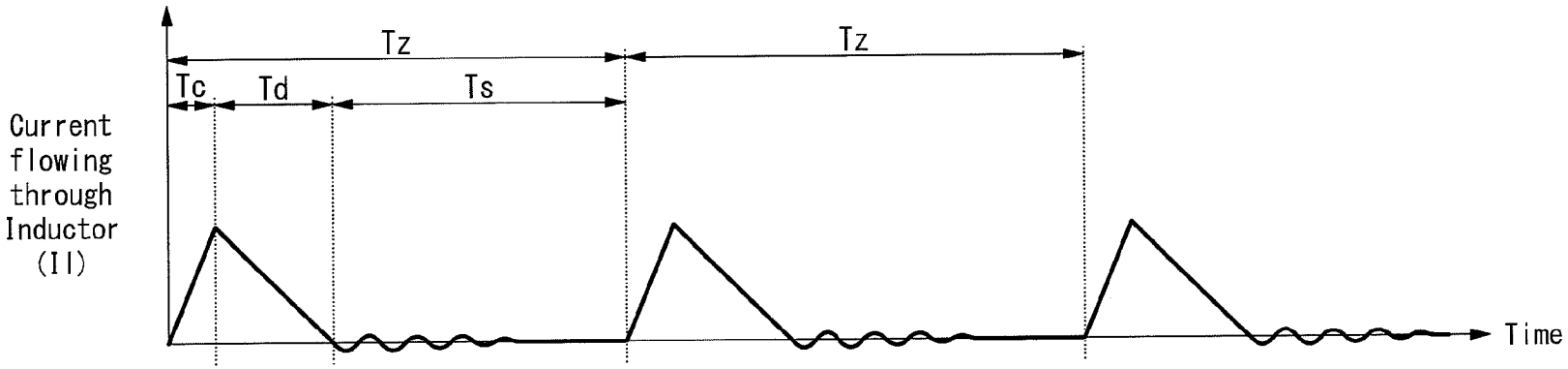
FIG. 12 is a waveform diagram of a current flowing through an inductor in a third light control mode in the lighting device according to the Second Embodiment.
Figure 13:
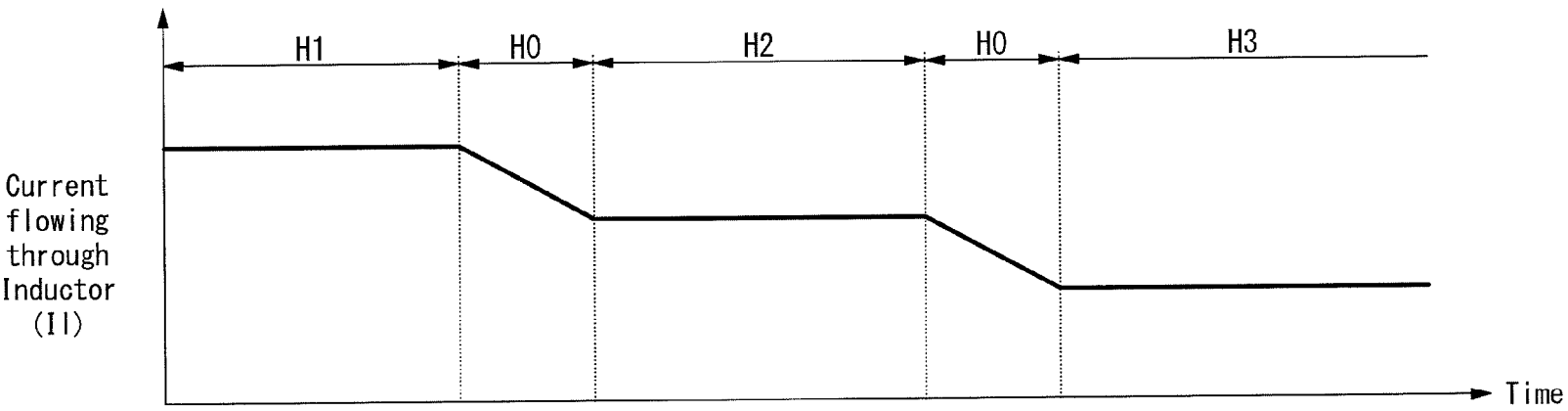
FIG. 13 is a diagram illustrating a change in a current flowing through the inductor when the light control mode is changed in the lighting device according to the Second Embodiment.

Hereinafter, it is considered a case where the lighting device 10 according to the present embodiment has, as the light control mode for controlling light output of the light source 20, three light control modes of a first light control mode, a second light control mode, and a third light control mode, similarly to the case of the lighting device 10 according to the First Embodiment. As described above, the lighting device 10 according to the present embodiment includes the second diode D2 that is provided on the electrical path to the input port 1*a* of the step-down chopper circuit 1. The anode of the second diode D2 is connected to the high potential side of the power supply 7, and the cathode of the second diode D2 is connected to the input port 1*a* of the step-down chopper circuit 1. The second diode D2 prevents a current from flowing from the input port 1*a* to a side of the power source 7. Accordingly, in the lighting device 10 of the present embodiment, fluctuation of the current $I_1$ flowing through the inductor L1 in the quiescent period Ts of the fixed period Tz caused by an LC circuit of the inductor L1 and a second capacitor (not shown) that is connected in parallel to the power supply 7 can be suppressed (see FIG. 12) compared with the lighting device 10 according to the First Embodiment. Accordingly, in the lighting device 10 of the present embodiment, it is possible to linearly change the current $I_1$ flowing through the inductor L1 at the fixed rate, as shown in FIG. 13, when the light control mode is changed. Therefore, in the lighting device 10 according to the present embodiment, it is possible to suppress the flicker occurring in the light emitted from the light source 20 when the light control mode is changed, compared with the lighting device 10 according to the First Embodiment. Note that FIG. 12 shows a change in the current $I_1$ flowing through the inductor L1 when the third light control mode is selected as the light control mode, in the lighting device 10 according to the present embodiment. In FIG. 12, Tc indicates an accumulation period during which electromagnetic energy is accumulated in the inductor L1. In FIG. 12, Td indicates a discharge period during which the electromagnetic energy stored in the inductor L1 is discharged. In FIG. 12, Ts indicates a quiescent period during which electromagnetic energy is neither accumulated in nor discharged from the inductor L1. In FIG. 13, H1 indicates a period during which the first light control mode is selected as the light control mode. In FIG. 13, H2 indicates a period during which the second light control mode is selected as the light control mode. In FIG. 13, H3 indicates a period during which the third light control mode is selected as the light control mode. In FIG. 13, H0 indicates periods when the light control mode is changed.

In the lighting device 10 according to the present embodiment, the second diode D2 is provided between the input port 1*a* of the step-down chopper circuit 1 and a power supply 7, but the position of the second diode D2 is not limited thereto. For example, in a lighting device 10, a second diode D2 may be provided on an electrical path between an input port 1*a* of a step-down chopper circuit 1 and a junction P1 of a cathode of a first diode D1 and a high potential side of a first capacitor C1. In this case, an anode of the second diode D2 is electrically connected to the input port 1*a* of the step-down chopper circuit 1, and a cathode of the second diode D2 is electrically connected to the junction P1.

The lighting device 10 according to the present embodiment may be applied to the luminaire 30 according to the First Embodiment.

In the lighting device 10 according to the present embodiment as described above, the second diode D2, which is different from the first diode D1 that is one of components of the step-down chopper circuit 1, is provided on the electrical path to the high potential side input port 1*a* in the step-down chopper circuit 1. The step-down chopper circuit 1 is configured to receive the DC voltage from the power supply 7 that is provided at an input side of the step-down chopper circuit 1. To be specific, the anode of the second diode D2 is connected to the high potential side of the power supply 7, and the cathode of the second diode D2 is connected to the high potential side input port 1*a* of the step-down chopper circuit 1. Accordingly, in the lighting device 10 according to the present embodiment, it is possible to suppress the flicker occurring in the light emitted from the light source 20, compared with the lighting device 10 according to the First Embodiment.

Third Embodiment

Figure 14:
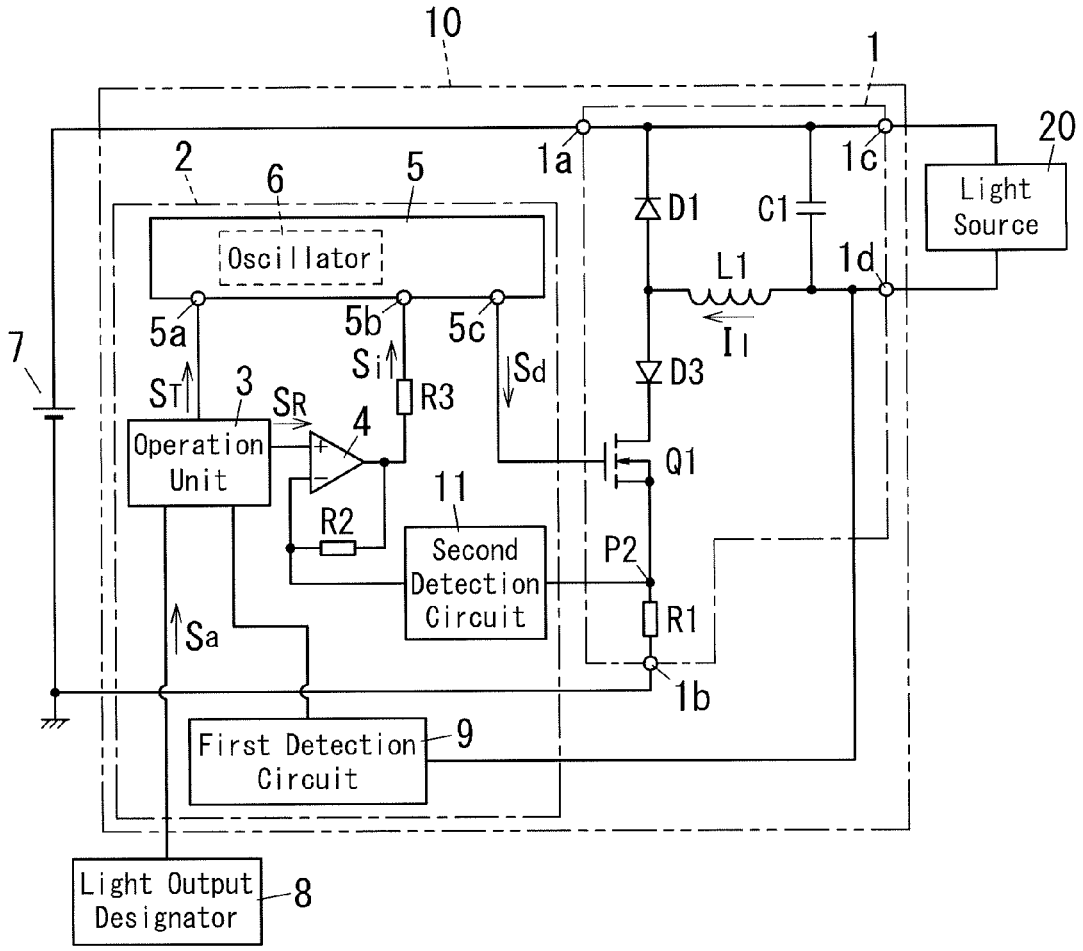
FIG. 14 is a circuit diagram of a luminaire including a lighting device according to a Third Embodiment.

A lighting device 10 according to the present embodiment has the same basic configuration as the First Embodiment, and differs from the First Embodiment in that a third diode D3 that is different from a first diode D1 is connected in series to a switching device Q1, as shown in FIG. 14. Note that, in the present embodiment, constituent elements similar to those in the First Embodiment are provided with the same reference numerals, and description thereof will be omitted as appropriate.

As shown in FIG. 14, an anode of the third diode D3 is electrically connected to an anode of the first diode D1, and the anode of the third diode D3 is also electrically connected to a second end of an inductor L1. A cathode of the third diode D3 is electrically connected to a drain of the switching device Q1. In short, in the third diode D3, the anode thereof is connected to a high potential side of a step-down chopper circuit 1, and the cathode thereof is connected to the drain of the switching device Q1.

It will be considered a case where the lighting device 10 according to the present embodiment has, as the light control mode for controlling light output of the light source 20, three light control modes of a first light control mode, a second light control mode, and a third light control mode, similarly to the case of the lighting device 10 according to the Second Embodiment. As described above, the lighting device 10 according to the present embodiment includes the third diode D3 that is connected in series to the switching device Q1. The anode of the third diode D3 is connected to the high potential side of the step-down chopper circuit 1, and the cathode of the third diode D3 is connected to the drain of the switching device Q1. The third diode D3 prevents a current from flowing from the switching device Q1 to a side of the inductor L1. Accordingly, in the lighting device 10 of the present embodiment, fluctuation of the current $I_1$ flowing through the inductor L1 in the quiescent period Ts of the fixed period Tz caused by an LC circuit of the inductor L1 and a parasitic capacitor (not shown) of the switching device Q1 can be suppressed (see FIG. 12) compared with the lighting device 10 according to the First Embodiment. Accordingly, in the lighting device 10 of the present embodiment as well, it is possible to linearly change the current $I_1$ flowing through the inductor L1 at a fixed rate, when the light control mode is changed (see FIG. 13). Therefore, in the lighting device 10 according to the present embodiment as well, it is possible to suppress the flicker occurring in the light emitted from the light source 20 when the light control mode is changed, compared with the lighting device 10 according to the First Embodiment.

In the lighting device 10 according to the present embodiment, the anode of the third diode D3 is connected to the high potential side of the step-down chopper circuit 1, and the cathode of the third diode D3 is connected to the drain of the switching device Q1, but the position of the third diode D3 is not limited thereto. For example, in a lighting device 10, an anode of a third diode D3 may be connected to a source of a switching device Q1, and a cathode of the third diode D3 may be connected to a low potential side of a step-down chopper circuit 1. To be specific, the anode of the third diode D3 may be electrically connected to the source of the switching device Q1, and the cathode of the third diode D3 may be electrically connected to a junction P2 of a first resistor R1 and a second detection circuit 11.

The lighting device 10 according to the present embodiment may be applied to the luminaire 30 according to the First Embodiment.

In the lighting device 10 according to the present embodiment as described above, the third diode D3, which is different from the first diode D1 that is one of components of the step-down chopper circuit 1, is connected in series to the switching device Q1. The switching device Q1 is a field-effect transistor. The third diode D3 is connected in series to the switching device Q1. To be specific, the anode of the third diode D3 is connected to the high potential side of the step-down chopper circuit 1, and the cathode of the third diode D3 is connected to the drain of the switching device Q1. Accordingly, in the lighting device 10 according to the present embodiment as well, it is possible to suppress the flicker occurring in the light emitted from the light source 20, compared with the lighting device 10 according to the First Embodiment.

In another example of the lighting device 10 according to the present embodiment, the anode of the third diode D3 is connected to the source of the switching device Q1, and the cathode of the third diode D3 is connected to the low potential side of the step-down chopper circuit 1. Accordingly, in this lighting device 10 as well, it is possible to suppress the flicker occurring in the light emitted from the light source 20, compared with the lighting device 10 according to the First Embodiment.

Fourth Embodiment

Figure 15:
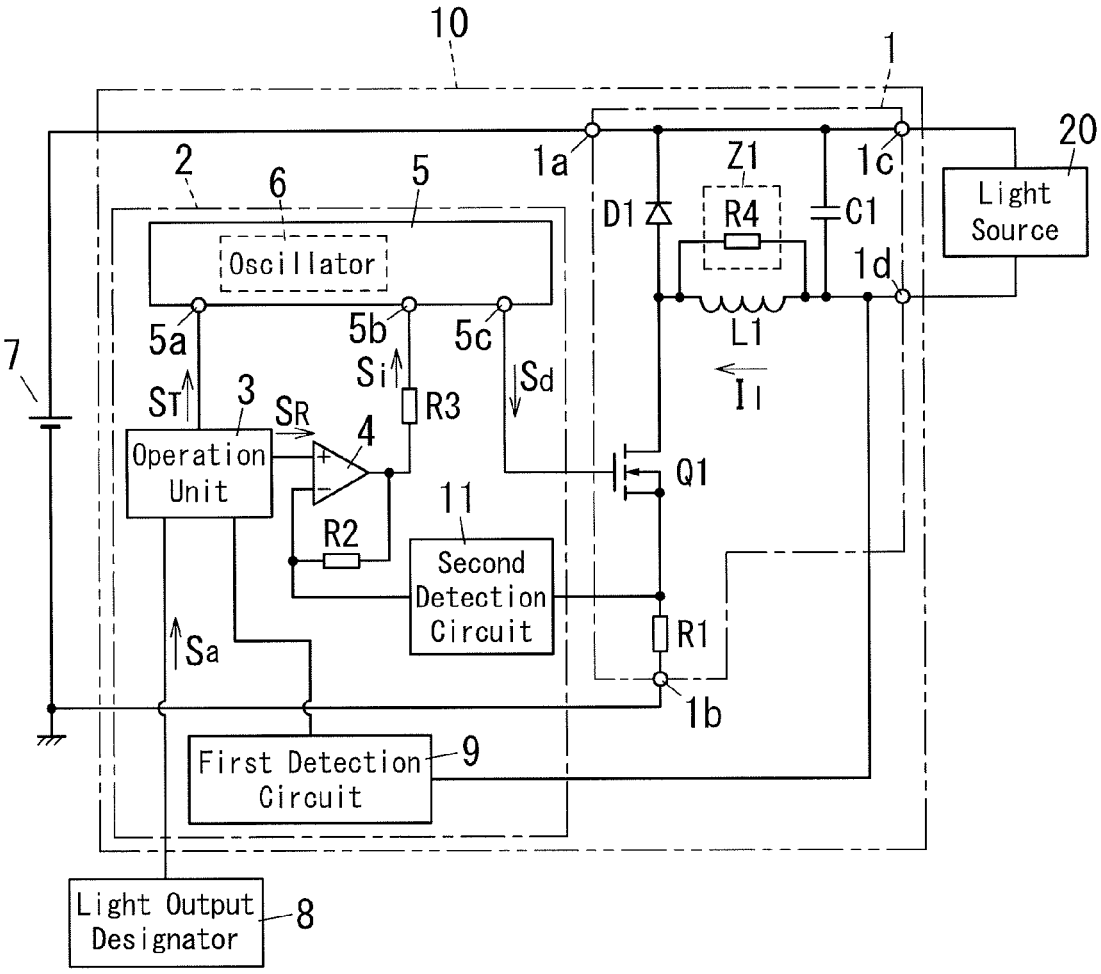
FIG. 15 is a circuit diagram of a luminaire including a lighting device according to a Fourth Embodiment.

A lighting device 10 according to the present embodiment has the same basic configuration as the First Embodiment, and differs from the First Embodiment in that an impedance element Z1 is connected in parallel to an inductor L1, as shown in FIG. 15. Note that, in the present embodiment, constituent elements similar to those in the First Embodiment are provided with the same reference numerals, and description thereof will be omitted as appropriate.

A resistor (a fourth resistor) R4 or the like can be employed as the impedance element Z1, for example.

Figure 16:
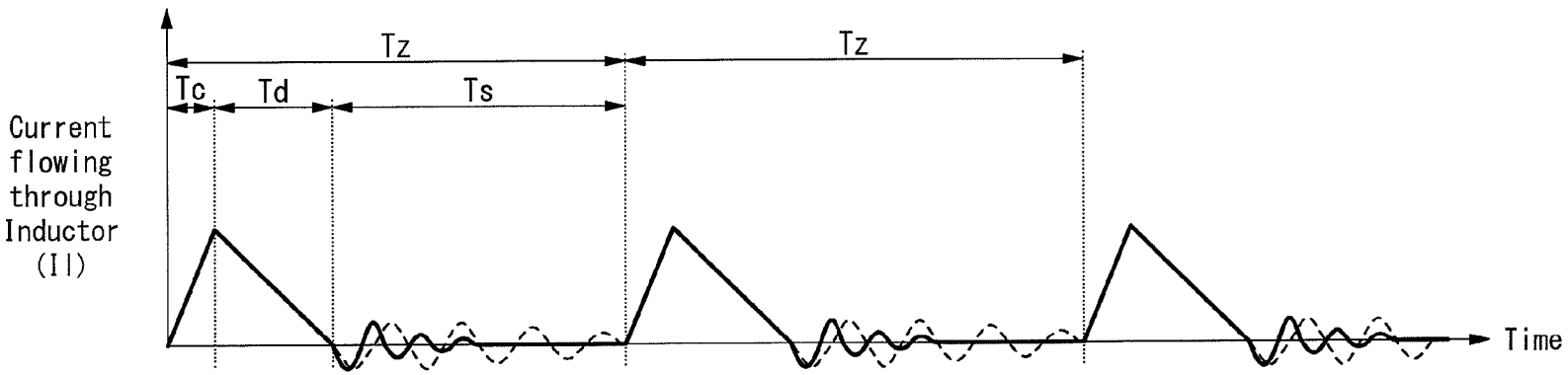
FIG. 16 is a waveform diagram of a current flowing through an inductor in a third light control mode in the lighting device of the Fourth Embodiment.

It will be considered a case where the lighting device 10 according to the present embodiment has, as the light control mode for controlling light output of a light source 20, three light control modes of a first light control mode, a second light control mode, and a third light control mode, similarly to the cases of the lighting devices 10 according to the Second and Third Embodiments. As described above, the lighting device 10 according to the present embodiment includes the impedance element Z1 that is connected in parallel to the inductor L1. Accordingly, in the lighting device 10 according to the present embodiment, in a quiescent period Ts of a fixed period Tz, part of a current that is to be flowed to the inductor L1 can be flowed to the impedance element Z1. Accordingly, in the lighting device 10 according to the present embodiment, it is possible to quickly attenuate a fluctuation of current $I_1$ flowing through the inductor L1 that occurs in the quiescent period Ts of the fixed period Tz due to an LC circuit of the inductor L1 and a first capacitor C1, as shown in FIG. 16, compared with the lighting device 10 according to the First Embodiment. In other words, in the lighting device 10 according to the present embodiment, it is possible to suppress the fluctuation of the current $I_1$ flowing through the inductor L1 in the quiescent period Ts due to the LC circuit of the inductor L1 and the first capacitor C1, compared with the lighting device 10 according to the First Embodiment. Accordingly, in the lighting device 10 according to the present embodiment, it is possible to linearly change the current $I_1$ flowing through the inductor L1 at a fixed rate, when the light control mode is changed (see FIG. 13). Therefore, in the lighting device 10 according to the present embodiment as well, it is possible to suppress the flicker occurring in the light emitted from the light source 20 when the light control mode is changed, compared with the lighting device 10 according to the First Embodiment. Note that FIG. 16 shows the change of the current $I_1$ flowing through the inductor L1 when a third light control mode is selected as the light control mode in the lighting device 10 according to the present embodiment. In FIG. 16, the broken line indicates the change of the current $I_1$ flowing through the inductor L1 when the third light control mode is selected as the light control mode in the lighting device 10 according to the First Embodiment. In FIG. 16, Tc indicates an accumulation period during which electromagnetic energy is accumulated in the inductor L1. In FIG. 16, Td indicates a discharge period during which the electromagnetic energy stored in the inductor L1 is discharged.

In the lighting device 10 according to the present embodiment, a resistor (the fourth resistor) R4 is employed as the impedance element Z1, but the impedance element is not limited thereto. For example, an impedance circuit formed of a combination of a resistor and a capacitor (a parallel circuit of a resistor and a capacitor, for example) may be employed as an impedance element Z1 in a lighting device 10.

The lighting device 10 according to the present embodiment may be applied to the luminaire 30 according to the First Embodiment, for example.

In the lighting device 10 according to the present embodiment as described above, the impedance element Z1 is connected in parallel to the inductor L1 that is one of components of a step-down chopper circuit 1. Accordingly, in the lighting device 10 according to the present embodiment as well, it is possible to suppress the flicker occurring in the light emitted from the light source 20, compared with the lighting device 10 according to the First Embodiment.

Further, it is possible to arbitrary combine the features that are described in the above Embodiments.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device configured to control light output of a light source comprising a solid-state light emitting device, the lighting device comprising:

a step-down chopper circuit configured to step down an input DC voltage to a DC voltage to be supplied to the light source; and a controller configured to control the step-down chopper circuit, wherein the controller is configured to turn on and off a switching device in the step-down chopper circuit at a fixed frequency, the controller comprises:

an operation unit configured to determine a reference voltage value based on a light output level designated by a light output control signal that instructs a light output of the light source, and a forward voltage of the light source;

an output unit configured to output, as a difference signal, a difference between the reference voltage value determined by the operation unit and an average value of a voltage that is proportional to a current flowing through the switching device; and a control circuit configured to determine an on-time period of the switching device, the control circuit comprises an oscillator configured to generate a voltage signal shaped like teeth of a saw, the control circuit is configured to determine the on-time period of the switching device based on a level of the voltage signal generated by the oscillator and a level of the difference signal supplied from the output unit, the step-down chopper circuit comprises:

a high potential side input port and a low potential side input port configured to be respectively connected to a high potential side and a low potential side of a power supply that is configured to supply the DC voltage to the step-down chopper circuit;

a first diode interposed between the high potential side input port and the low potential side input port so that a cathode of the first diode is connected to a side of the high potential side input port and an anode of the first diode is connected to a side of the low potential side input port;

the switching device interposed between the first diode and the low potential side input port; and a series circuit, of an output capacitor and an inductor, connected across the first diode so that a side of the output capacitor is connected to the cathode of the first diode and a side of the inductor is connected to a junction of an anode of the first diode and the switching device, the voltage signal has a fixed frequency, and has, at a start of every period, a first period during which a level of the voltage signal increases at a fixed rate from a pre-set minimum value, and the control circuit is configured, for every period, to turn on the switching device at an initial time of a first period, and turn off the switching device based on the level of the voltage signal generated by the oscillator and the level of the difference signal supplied from the output unit.

2. The lighting device according to claim 1, wherein the control circuit is configured to turn off the switching device when the level of the voltage signal generated by the oscillator reaches the level of the difference signal supplied from the output unit.

3. The lighting device according to claim 1, comprising a first diode and a second diode, wherein the first diode is one of components of the step-down chopper circuit, and the second diode is provided on an electrical path to a high potential side input port of the step-down chopper circuit.

4. The lighting device according to claim 3, wherein the step-down chopper circuit is configured to receive the DC voltage from a power supply that is provided at an input side of the step-down chopper circuit, and an anode of the second diode is connected to a high potential side of the power supply, and a cathode of the second diode is connected to the high potential side input port of the step-down chopper circuit.

5. The lighting device according to claim 1, comprising a first diode and a third diode, wherein the first diode is one of components of the step-down chopper circuit, and the third diode is connected in series to the switching device.

6. The lighting device according to claim 5, wherein the switching device is a field-effect transistor, and an anode of the third diode is connected to a high potential side of the step-down chopper circuit, and a cathode of the third diode is connected to a drain of the switching device.

7. The lighting device according to claim 5, wherein the switching device is a field-effect transistor, and an anode of the third diode is connected to a source of the switching device, and a cathode of the third diode is connected to a low potential side of the step-down chopper circuit.

8. The lighting device according to claim 1, comprising an inductor and an impedance element, wherein the inductor is one of components of the step-down chopper circuit, and the impedance element is connected in parallel to the inductor.

9. A luminaire comprising:

a lighting device; and a light source, wherein the lighting device is configured to control light output of the light source comprising a solid-state light emitting device, the lighting device comprising:

a step-down chopper circuit configured to step down an input DC voltage to a DC voltage to be supplied to the light source; and a controller configured to control the step-down chopper circuit, the controller is configured to turn on and off a switching device in the step-down chopper circuit at a fixed frequency, the controller comprises:

an operation unit configured to determine a reference voltage value based on a light output level designated by a light output control signal that instructs a light output of the light source, and a forward voltage of the light source;

an output unit configured to output, as a difference signal, a difference between the reference voltage value determined by the operation unit and an average value of a voltage that is proportional to a current flowing through the switching device; and a control circuit configured to determine an on-time period of the switching device, the control circuit comprises an oscillator configured to generate a voltage signal shaped like teeth of a saw, the control circuit is configured to determine the on-time period of the switching device based on a level of the voltage signal generated by the oscillator and a level of the difference signal supplied from the output unit, the step-down chopper circuit comprises:

a high potential side input port and a low potential side input port configured to be respectively connected to a high potential side and a low potential side of a power supply that is configured to supply the DC voltage to the step-down chopper circuit;

a first diode interposed between the high potential side input port and the low potential side input port so that a cathode of the first diode is connected to a side of the high potential side input port and an anode of the first diode is connected to a side of the low potential side input port;

the switching device interposed between the first diode and the low potential side input port; and a series circuit, of an output capacitor and an inductor, connected across the first diode so that a side of the output capacitor is connected to the cathode of the first diode and a side of the inductor is connected to a junction of an anode of the first diode and the switching device, the voltage signal has a fixed frequency, and has, at a start of every period, a first period during which a level of the voltage signal increases at a fixed rate from a pre-set minimum value, and the control circuit is configured, for every period, to turn on the switching device at an initial time of a first period, and turn off the switching device based on the level of the voltage signal generated by the oscillator and the level of the difference signal supplied from the output unit.

* * * * *